US012808548B2

(12) United States Patent
Gallivanoni et al.

(10) Patent No.: US 12,808,548 B2
(45) Date of Patent: Nov. 24, 2026

(54) VENTHOB WITH INTEGRATED INDUCTION COIL

(71) Applicant: WHIRLPOOL CORPORATION, Benton Harbor, MI (US)

(72) Inventors: Andrea Gallivanoni, Casorate Sempione (IT); Annalisa Pacioni, Bresso (IT); Andrea Luigi Rainoldi, Bresso (IT)

(73) Assignee: Whirlpool Corporation, Benton Harbor, MI (US)

( * ) Notice: Subject to any disclaimer, the term of this patent is extended or adjusted under 35 U.S.C. 154(b) by 375 days.

(21) Appl. No.: 18/512,408

(22) Filed: Nov. 17, 2023

(65) Prior Publication Data

US 2024/0167697 A1 May 23, 2024

Related U.S. Application Data

(60) Provisional application No. 63/384,651, filed on Nov. 22, 2022.

(51) Int. Cl.
*F24C 15/20* (2006.01)

(52) U.S. Cl.
CPC ..... *F24C 15/2042* (2013.01); *F24C 15/2021* (2013.01); *F24C 15/2085* (2013.01)

(58) Field of Classification Search
CPC ..... F24C 15/2021; F24C 15/103; F24C 15/2042; F24C 15/2085
See application file for complete search history.

(56) References Cited

U.S. PATENT DOCUMENTS

| | | | | |
|---|---|---|---|---|
| 2,674,991 | A | 4/1954 | Schaefer | |
| 3,409,005 | A | 11/1968 | Field | |
| 4,446,849 | A | 5/1984 | McFarland | |
| 4,603,684 | A | 8/1986 | Kazuo et al. | |
| 4,850,335 | A | 7/1989 | Farnsworth et al. | |
| 2010/0163549 | A1* | 7/2010 | Gagas | F24C 15/2042 219/622 |
| 2018/0073745 | A1 | 3/2018 | Norman et al. | |

FOREIGN PATENT DOCUMENTS

| | | | |
|---|---|---|---|
| DE | 102015104470 | A1 | 9/2016 |
| EP | 3425282 | B1 | 4/2021 |
| FR | 2701542 | B1 | 3/1995 |
| WO | 2017186432 | A1 | 11/2017 |
| WO | 2020002456 | A1 | 1/2020 |
| WO | 2022117367 | A1 | 6/2022 |

* cited by examiner

*Primary Examiner* — Alfred Basichas
(74) *Attorney, Agent, or Firm* — Price Heneveld LLP

(57) ABSTRACT

A cooking appliance includes a cooktop including an outer perimeter and defining at least one opening. A plurality of burners located on the cooktop and at least one burner of the plurality of burners is located on at least one turret that defines an internal cavity to direct a downdraft. The at least one turret is moveable within the at least one opening between at least one vacuum position and a flush position.

19 Claims, 11 Drawing Sheets

VENTHOB WITH INTEGRATED INDUCTION COIL

CROSS-REFERENCE TO RELATED APPLICATION

This application claims priority to and the benefit under 35 U.S.C. § 119(e) of U.S. Provisional Application No. 63/384,651, filed on Nov. 22, 2022, entitled "VENTHOB WITH INTEGRATED INDUCTION COIL," the disclosure of which is hereby incorporated herein by reference in its entirety.

BACKGROUND OF THE DISCLOSURE

The present disclosure generally relates to a cooktop, and, more specifically, to a cooktop having at least one burner located on a turret that is configured to direct steam and cooking odors from the cooktop.

SUMMARY OF THE DISCLOSURE

According to an aspect of the present disclosure, a cooking appliance includes a cooktop including an outer perimeter and defining at least one opening. A plurality of burners located on the cooktop and at least one burner of the plurality of burners is located on at least one turret that defines an internal cavity to direct a downdraft. The at least one turret is moveable within the at least one opening between at least one vacuum position and a flush position.

According to another aspect of the present disclosure, a cooking appliance includes a cooktop having an outer perimeter and defining an opening and a condition sensor that is configured to detect a particulate presence of at least one of smoke, steam, or odors around the cooktop. A plurality of burners are located on the cooktop. At least one burner of the plurality of burners is located on a turret that defines an internal cavity to direct a downdraft. The turret is moveable within the opening between at least one vacuum position and a flush position. A control unit configured to receive the detected particulate presence from the condition sensor and generate a movement signal to move the turret from the flush position to the at least one vacuum position.

According to yet another aspect of the present disclosure, a cooking appliance includes a cooktop having an outer perimeter and defining a pair of openings. A pair of burners are located on the cooktop. A pair of turrets with each turret located in a different one of the pair of openings. Each turret is connected to a different one of the pair of burners. Each turret defines an internal cavity to direct a downdraft and each turret is moveable within a respective one of the at least two openings between at least one vacuum position and a flush position.

These and other features, advantages, and objects of the present disclosure will be further understood and appreciated by those skilled in the art by reference to the following specification, claims, and appended drawings.

Figure 1:
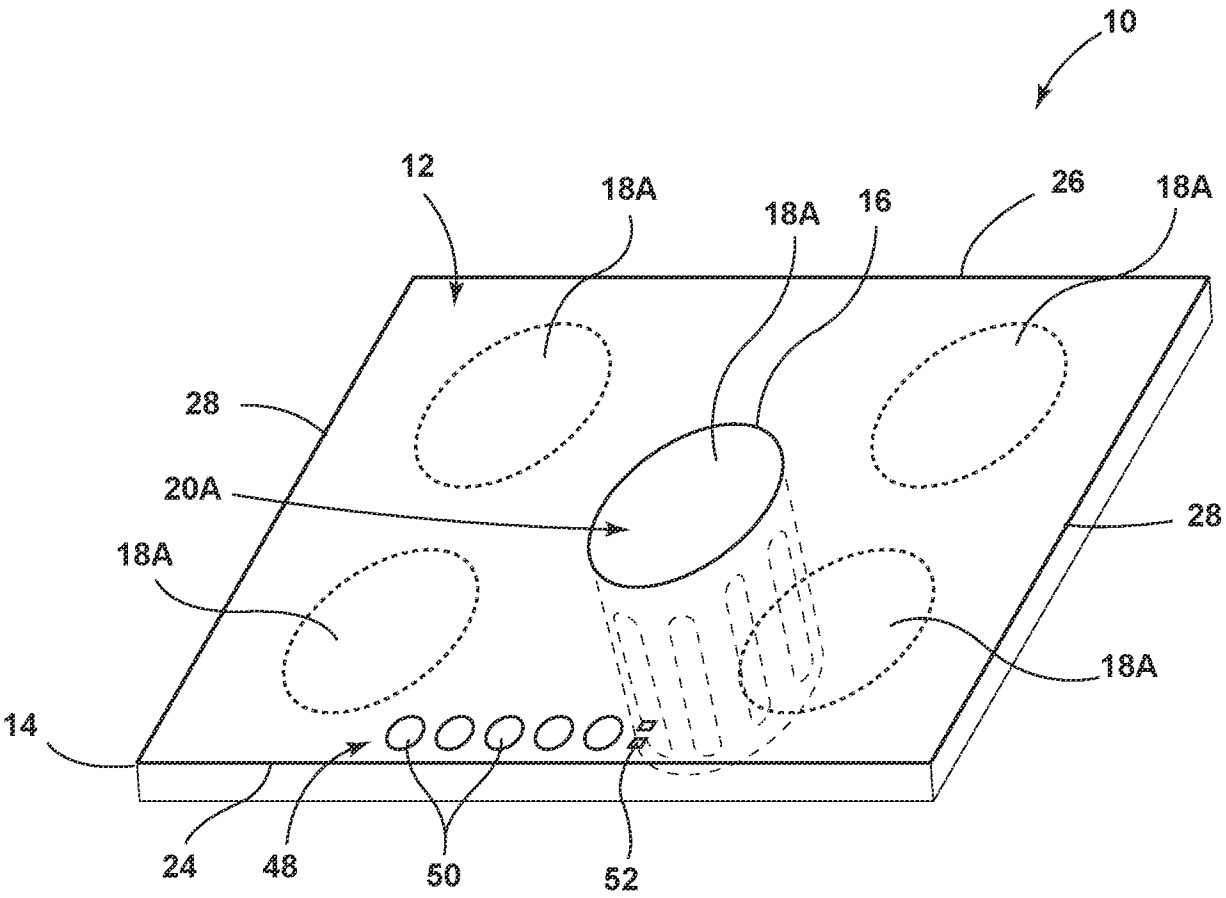
FIG. 1 is a top perspective view of a cooking appliance with a turret of a first construction in a flush position, according to an aspect of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a cooktop having at least one burner located on a turret that is configured to direct steam and cooking odors from the cooktop. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
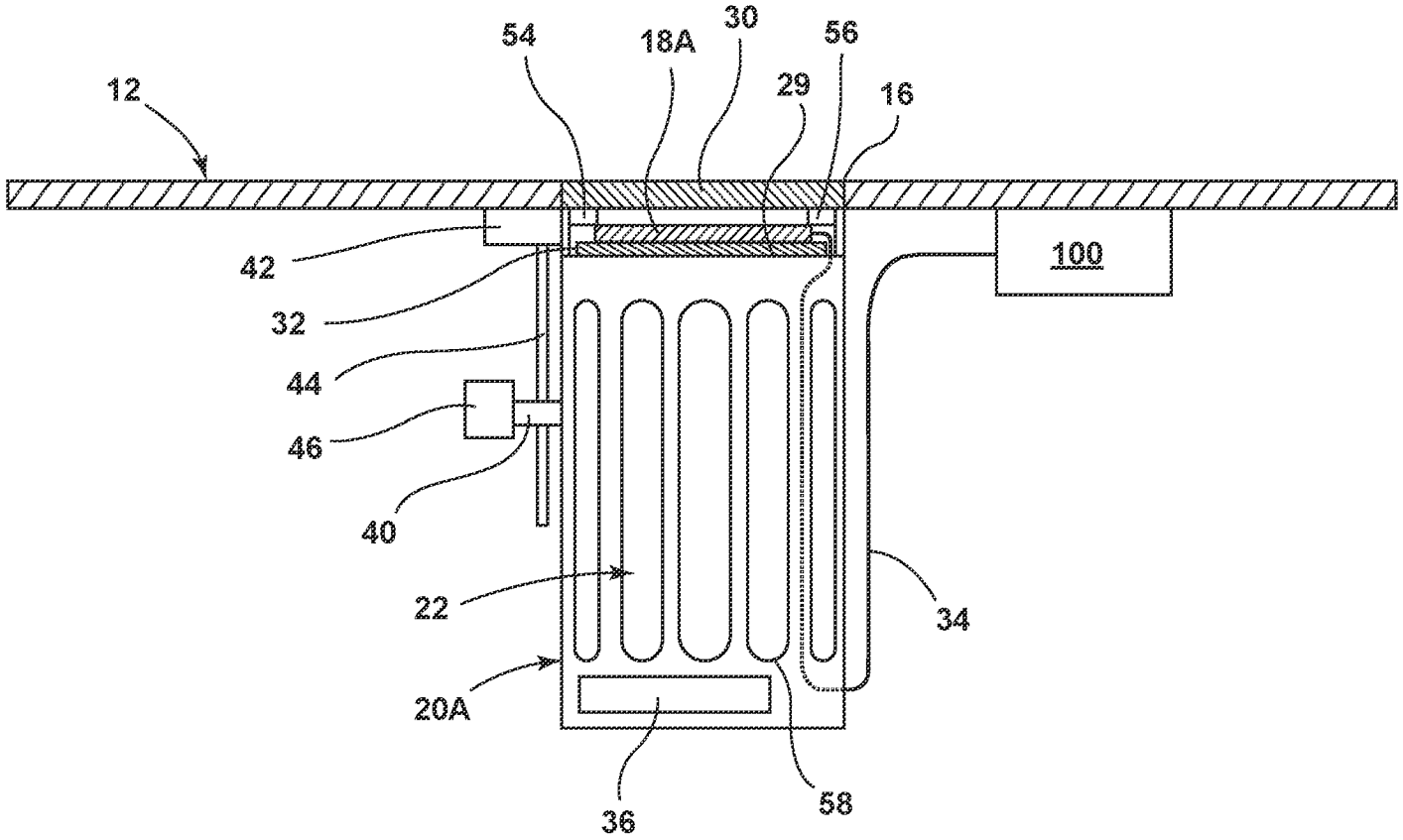
FIG. 2 is a cross-sectional side view of a cooktop and the turret in a flush position, according to an aspect of the present disclosure.

Referring to FIGS. 1-4, reference numeral 10 generally designates a cooking appliance that includes a cooktop 12. The cooktop 12 includes an outer perimeter 14 and defines an opening 16. At least one burner 18A in accordance with a first construction is located on the cooktop 12. At least one burner 18A of the plurality of burners 18A is located on a turret 20A in accordance with a first construction that defines an internal cavity 22 to direct a downdraft. The turret 20A is moveable within the opening 16 between at least one vacuum position (FIGS. 3 and 4) and a flush position (FIGS. 1 and 2).

With reference now to FIG. 1, the outer perimeter 14 of the cooktop 12 includes a front edge 24, a rear edge 26, and a pair of side edges 28 that extend between the front edge 24 and the rear edge 26. The at least one burner 18A may include a plurality of burners 18A (e.g., two, three, four, five, or more burners). The plurality of burners 18A may include one or more burners 18A that are stationary (i.e., not coupled to the turret 20A) and one or more burners 18A that are coupled to and moveable with the turret 20A. In the illustrated example, the turret 20A is located centrally within the outer perimeter 14 and a single burner 18A is coupled to the turret 20A. The turret 20A includes a top surface 29 and the burner 18A is located on the top surface 29. In some embodiments, a glass top 30 may be coupled to the turret 20A above the top surface 29 such that the burner 18A coupled to the turret 20A is located between the top surface 29 and the glass top 30. In the flush position, the glass top 30, or the burner 18A when the glass top 30 is not included, on the turret 20A may reside substantially on a same plane as the cooktop 12 (e.g., a cooktop glass cover). An insulating base 32 may be located between the turret 20A and the burner 18A. A power conduit 34 is connected to and extends between the burner 18A located on the turret 20A to a control unit 100 (FIG. 10) configured to generate a signal to heat the burner 18A. In some embodiments, the control unit 100 is configured to administer heating to both the stationary and moveable burners 18A.

Figure 3:
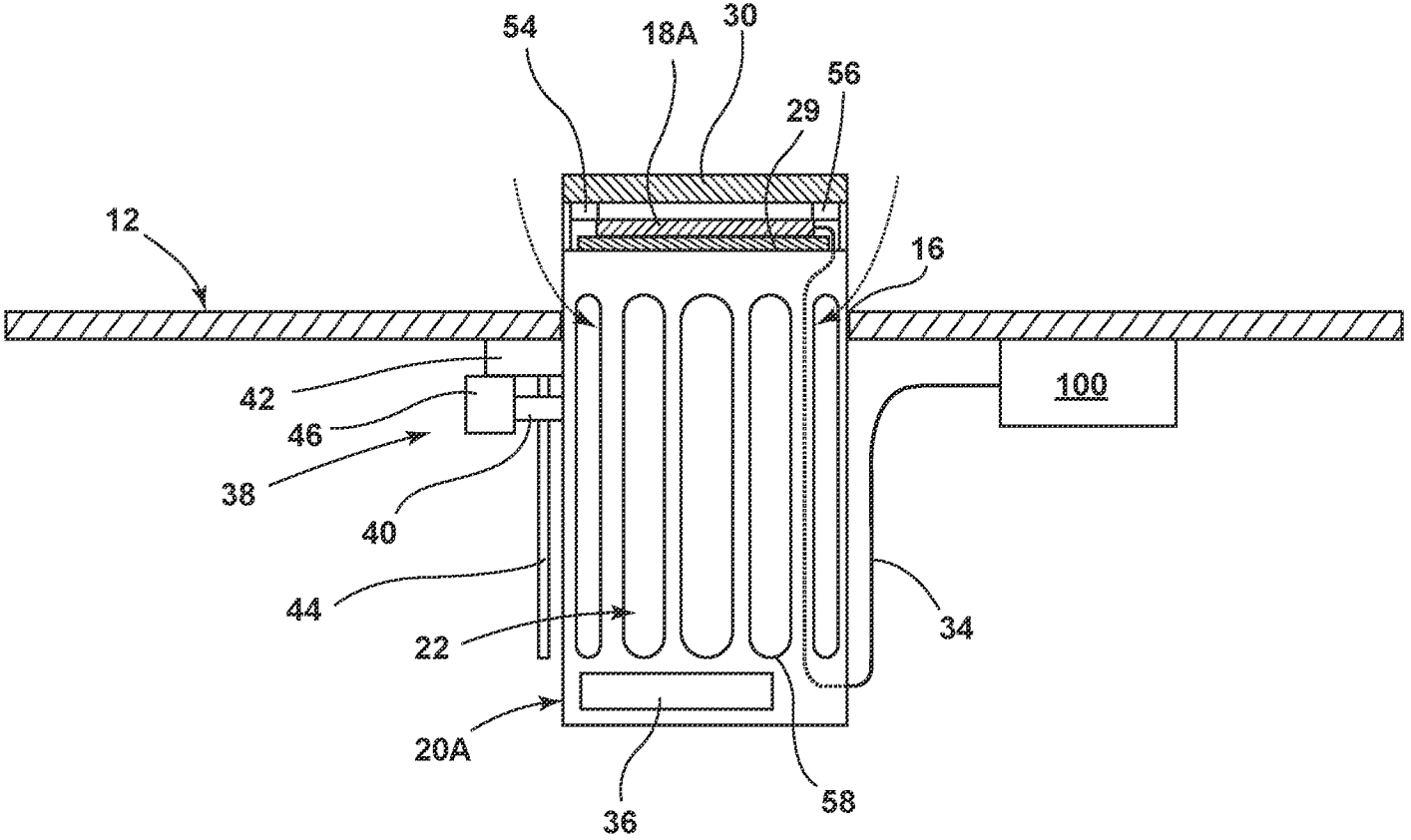
FIG. 3 is a cross-sectional side view of a cooktop with a turret in a first vacuum position, according to an aspect of the present disclosure.
Figure 4:
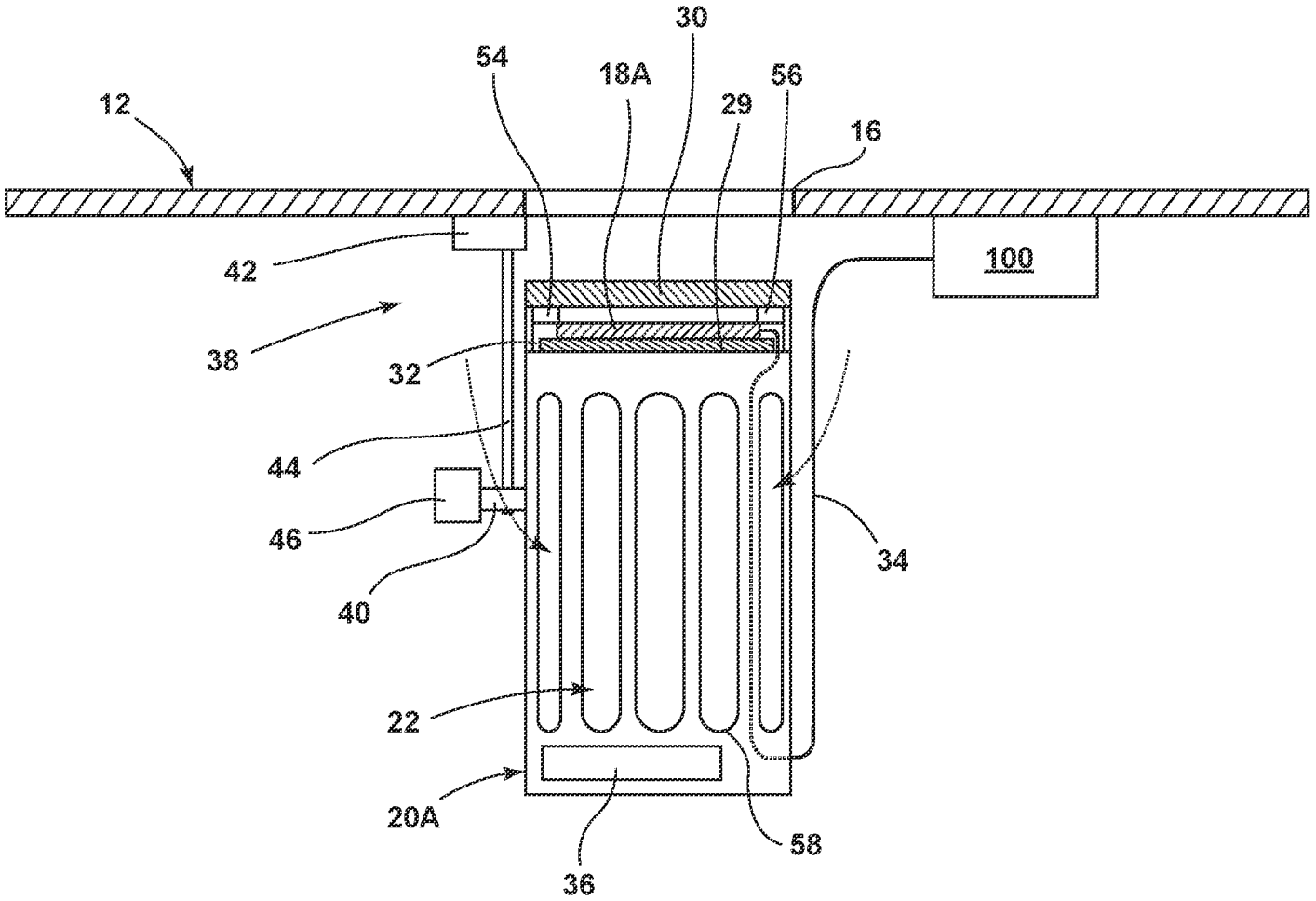
FIG. 4 is a cross-sectional side view of a cooktop and the turret in a second vacuum position, according to an aspect of the present disclosure.

With reference now to FIGS. 2-4, a vacuum component 36 (e.g., a motor driven fan or a pump) is in fluidic communication with the internal cavity 22 of the turret 20A and creates the downdraft. The control unit 100 may be further configured to generate a signal to the vacuum component produce the downdraft created by the vacuum component 36. While the vacuum component 36 may be located within the internal cavity 22, as illustrated, it should be appreciated that the internal cavity 22 of the turret 20A may be connected to one or more vacuum lines that direct air to other locations around and out of the cooking appliance 10. In this manner, it should also be appreciated that the vacuum component 36 may be located outside of the internal cavity 22 and somewhere along the one or more vacuum lines. In this manner, when one or more turrets 20A are included, a single vacuum component 36 may be utilized for creating the downdraft in multiple turrets 20A.

With continued reference to FIGS. 2-4, a movement assembly 38 is configured to move the turret 20A between the at least one vacuum position and the flush position. The movement assembly 38 may be configured to be gear-driven, pneumatically driven, hydraulically driven, and/or the like. For example, the movement assembly 38 may include a first end 40 connected to turret 20A, a second end 42 connected to at least one of the cooking appliance 10 or a surrounding structure, and a driven component 44. The driven component 44 may include a lead screw, a rack and pinion or other gear configurations, fluid within a line, and/or the like, that is driven/actuated by a driving component 46. The driving component 46 may be integrated in the first end 40 or the second end 42. The driving component 46 may include a motor, a pump, and/or the like. The driving component 46 may be operably connected to the driven component 44 via a driving nut, a driving gear (e.g., a pinion gear), a valve, and/or the like. As shown in FIGS. 2-4, the driven component 44 is illustrated as a lead screw and the driving component 46 is illustrated as a motor. With continued reference to the illustrated embodiment, the first end 40 is illustrated as a floating nut and the second end 42 is illustrated as a clamp that statically connects the lead screw to an underside of the cooktop 12. In some embodiments, the motor may be statically connected to the cooktop or other nearby structures while the lead screw floats. The control unit 100 may be further configured to generate a movement signal to the movement assembly 38 in order to move the turret 20A between positions.

With reference now to FIGS. 1-4, the cooking appliance 10 may include a user interface 48 that includes inputs 50 (e.g., knobs, buttons, touchscreen) to control functions (e.g., heating) of the cooktop 12 and one or more communication modules 52 (e.g., lights, displays, sound generators) for generating notifications to a user. In some embodiments, user communication to and from the user interface 48 may be administered by the control unit 100. More particularly, the control unit 100 may be configured to move the turret 20A (i.e., via the movement assembly 38) in response to user input to the user interface 48. In some embodiments, the control unit 100 may be configured to move the turret 20A (i.e., via the movement assembly 38) automatically in response to a steam and/or smoke condition. For example, the cooking appliance 10 may include at least one condition sensor 54 for detecting particulates in the air around the cooktop 12 (e.g., a steam sensor, smoke sensor, a Volatile Organic Compound sensor, the like, and/or combinations thereof) configured to determine air conditions within a threshold value (e.g., the presence and quantity of steam, smoke, odors, or other particulates). The at least one condition sensor 54 may include two or more condition sensors for measuring different air conditions. The control unit 100 may, therefore, be configured to automatically move the turret 20A in response to the air condition. In some embodiments, the control unit 100 may be configured to move the turret 20A in response to the heating of one or more burners 18A. The cooking appliance 10 may further include at least one presence sensors 56 configured to determine the presence of a cooking vessel 57 (FIG. 6) over the turret 20A. The presence sensor 56 may include a camera, an induction or current signal received by the one or more burners 18A, a weight sensor, or any other type of presence sensing technology. The at least one presence sensors 56 may include two or more presence sensors. More particularly, the presence sensor 56 may determine if the cooking vessel 57 overlaps the opening 16 defined by the cooktop 12 and whether or not the cooking vessel 57 is centered on the burner 18A or is in an unsafe position. For example, the unsafe position may include a position where the cooking vessel 57 is not centered on the burner 18A and susceptible to tipping and spilling the contents of the cooking vessel 57 upon movement of the turret 20A. Upon a determination that a cooking vessel 57 is in the unsafe position, the control unit 100 may prevent movement of the turret 20A or otherwise set a limit of travel for the turret 20A (e.g., 1 cm or less, 2 cm or less, 3 cm or less) where the cooking vessel 57 is not susceptible to over tipping and spilling the contents. In some embodiments, the condition sensor 54 and/or the presence sensor 56 may be coupled to the cooking appliance 10 (e.g., the cooktop 12, the turret 20A, the burner 18A, the top surface 29, the glass top 30, and/or the insulating base 32). In some embodiments, the condition sensor 54 and/or the presence sensors 56 may be in a spaced relationship to the cooking appliance 10 (e.g., in an overhead ventilation hood) and in wired and/or wireless communication with the control unit 100. In some embodiments the condition sensor 54 and/or the presence sensor 56 may be located under the glass top 30 within close proximity to a perimeter of the opening 16.

With reference now to FIGS. 3 and 4, the at least one vacuum position may include a single vacuum position or two or more vacuum positions. The at least one vacuum position may include an extended position (FIG. 3) where the top glass of the turret 20A resides above the cooktop 12, and/or a retracted position (FIG. 4) where the top glass 30 of the turret 20A resides below the cooktop 12. In both the extended and retracted positions, the top glass 30 becomes misaligned with the cooktop 12 allowing air to flow therethrough and into the turret 20A. In some embodiments, the at least one burner 18A located on the turret 20A (i.e., the moveable burner 18A) is configured to be heated in the at least one vacuum position and the flush position. The turret 20A may include at least one vent port 58 (e.g., a plurality of vent ports 58) fluidically connected to the internal cavity 22. The at least one vent port 58 may be elongated along a length (i.e., in the direction of movement) of the turret 20A. In addition to the extended position and the retracted position, it should be appreciated that the control unit 100 may be configured to have precise control over movement of the turret 20A. More particularly, the control unit 100 may move the turret 20A between intermediate positions that are partially extended and retracted. In some embodiments, the extended position may include raising the turret 20A until the vent ports 58 are raised above the cooktop 12. In such embodiments, the vent ports 58 may be raised partially, entirely, or any amount over the cooktop 12.

With reference now to FIGS. 5A-9, various constructions of turrets are illustrated in plan view. It should be appreciated that the shapes depicted correspond to an outer perimeter of the glass top 30 relative to the various burners. Generally speaking, the outer perimeter of the glass top 30 is sized and shaped to correspond to the opening 16. More particularly, the outer perimeter of the glass top 30 is sized and shaped to closely match that of the opening 16 while allowing the glass top 30 to pass through the opening 16 as the turrets of various constructions are moved between positions. Therefore, while the different constructions of turrets are described as having different shapes (i.e., different shapes of the glass top 30), it should be appreciated that the openings 16 may have similar and corresponding shapes. An underlying body of the turrets of various constructions (e.g., the portion defining the vent ports 58) may be sized to match the outer perimeter of the glass top 30 or smaller for embodiments that include the extended position. However, it should be appreciated that some embodiments may be configured to only employ the retracted position and flush position. In such embodiments, it is possible that the underlying body may be larger than the outer perimeter of the glass 30 because it will not travel through the opening 16 during ventilation. A cross-section of the underlying body of the turrets of various constructions may have a same or different shape to the outer perimeter of the glass top 30. In still further embodiments, the underlying body as shown in FIGS. 2-4 is exemplary in nature. For example, underlying body of the turrets of various constructions may defining multiple internal cavities 22 (e.g., a manifold) that merge at a ventilation output (not shown).

Figure 5A:
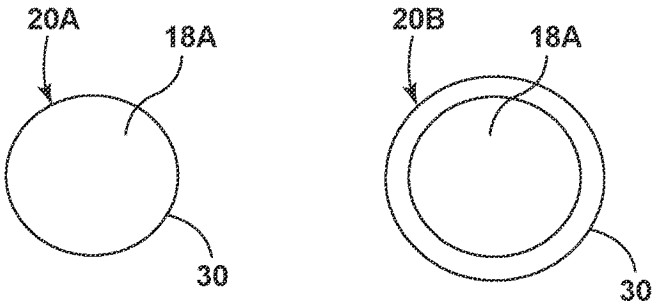
FIG. 5A is a plan view of a turret of a first construction, according to various aspects of the present disclosure.
Figure 5B:
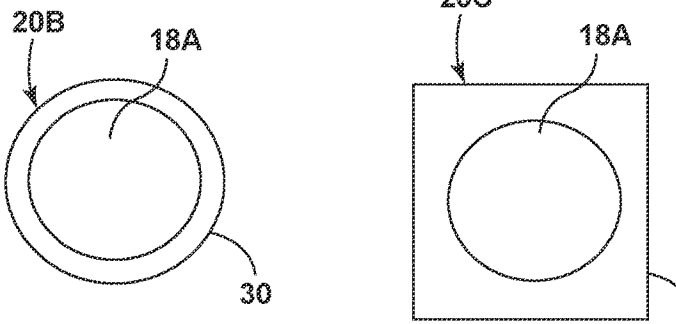
FIG. 5B is a plan view of a turret of a second construction, according to various aspects of the present disclosure.
Figure 5C:
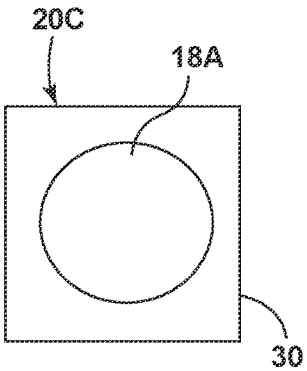
FIG. 5C is a plan view of a turret of a third construction, according to various aspects of the present disclosure.
Figure 5D:
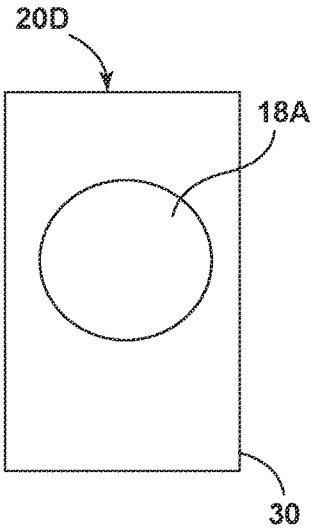
FIG. 5D is a plan view of a turret of a fourth construction, according to various aspects of the present disclosure.
Figure 5E:
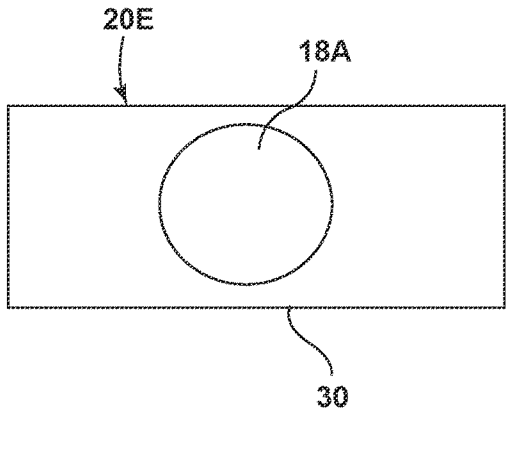
FIG. 5E is a plan view of a turret of a fifth construction, according to various aspects of the present disclosure.
Figure 5F:
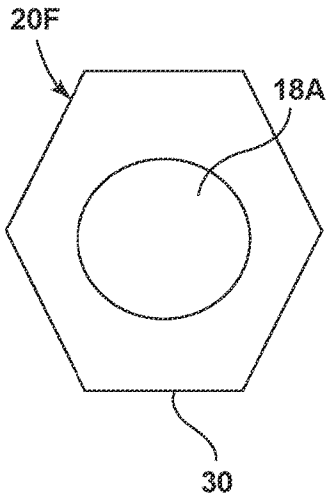
FIG. 5F is a plan view of a turret of a sixth construction, according to various aspects of the present disclosure.
Figure 5G:
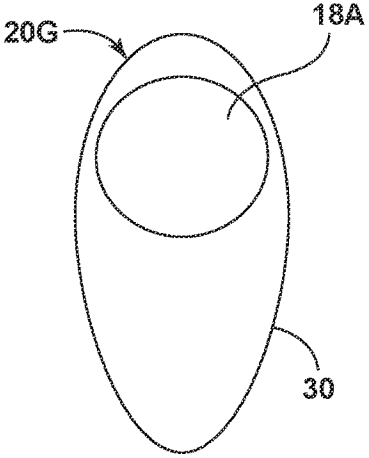
FIG. 5G is a plan view of a turret of a seventh construction, according to various aspects of the present disclosure.

In FIG. 5A, the turret 20A of the first construction from FIGS. 1-4 is illustrated from a plan view. The glass top 30 of the turret 20A may have a circular outer perimeter with a substantially uniform radius. The burner 18A coupled to the turret 20A extends substantially to the outer perimeter. In FIG. 5B, a turret 20B of a second construction is illustrated from a plan view. The glass top 30 of the turret 20B may also have a circular outer perimeter with a substantially uniform radius. However, the burner 18A defines an outer perimeter (e.g., circular) that smaller than the outer perimeter of the glass top 30. In FIG. 5C, a turret 20C of a third construction is illustrated from a plan view. The glass top 30 of the turret 20C may have a square outer perimeter of equal sides and the burner 18A may be aligned substantially in the center of the outer perimeter of the glass top 30. In FIG. 5D, a turret 20D of a fourth construction is illustrated from a plan view. The glass top 30 of the turret 20D may have a rectilinear perimeter. More particularly, the glass top 30 may be defined by a rectangular outer perimeter with a pair of perpendicular sides being longer than a pair of transverse sides. In the fourth construction, the longer sides of the glass top 30 may extend in a direction from the front edge 24 towards the rear edge 26. In some embodiments, the longer sides may be substantially parallel to the side edges 28. In FIG. 5E, a turret 20E of a fifth construction is illustrated from a plan view. The glass top 30 of the turret 20E may also have a rectilinear outer perimeter. More particularly, glass top 30 may be defined by a rectangular outer perimeter with a pair of perpendicular sides being shorter than a pair of transverse sides. In the fifth construction, the longer sides of the glass top 30 may extend in a direction from the side edge 28 towards the other side edge 28. In some embodiments, the longer sides may be substantially parallel to the front and rear edges 24, 26. In FIG. 5F, a turret 20F of a sixth construction is illustrated from a plan view. In the sixth construction, the glass top 30 of the turret 20F may include a polygon-type outer perimeter (e.g., with five through twelve sides) and the burner 18A may be aligned therewith (e.g., centrally). In FIG. 5G, a turret 20G of a seventh construction is illustrated from a plan view. In the seventh construction, the glass top 30 of the turret 20G may include an elongated outer perimeter, such as an oval and the burner 18A may be aligned therewith (e.g., on one end of the oval or centrally).

With reference now to FIGS. 5A-5G, it should be appreciated that alternative constructions of turrets or that turrets 20A-20G may be utilized. For example, the alternative constructions may include turrets having glass tops 30 with outer perimeters defining triangular shapes, L-shapes, and any other shape that may be beneficial in accordance with burner 18A location, distribution, and heating principles. It should also be appreciated that, other than the first construction of the turret 20A, one, two, or more burners 18A may be located on each turret 20B-20G. In some embodiments, the cooking appliance 10 may include two or more turrets 20A-20G with any of the constructions described herein. The turret 20A-20G may be located anywhere within or on the outer perimeter 14 of the cooktop 12. Each construction of the turret 20A-20G described herein may share the same mechanisms, components, and operational methods as the turret 20A illustrated in FIGS. 1-5A. In addition, it should be appreciated that the burners 18A described herein may include radiant, conductive, induction, or other heating configurations. Moreover, as will be described in greater detail below, the burner 18A itself may have a variety of shapes, configurations, and constructions.

Figure 6:
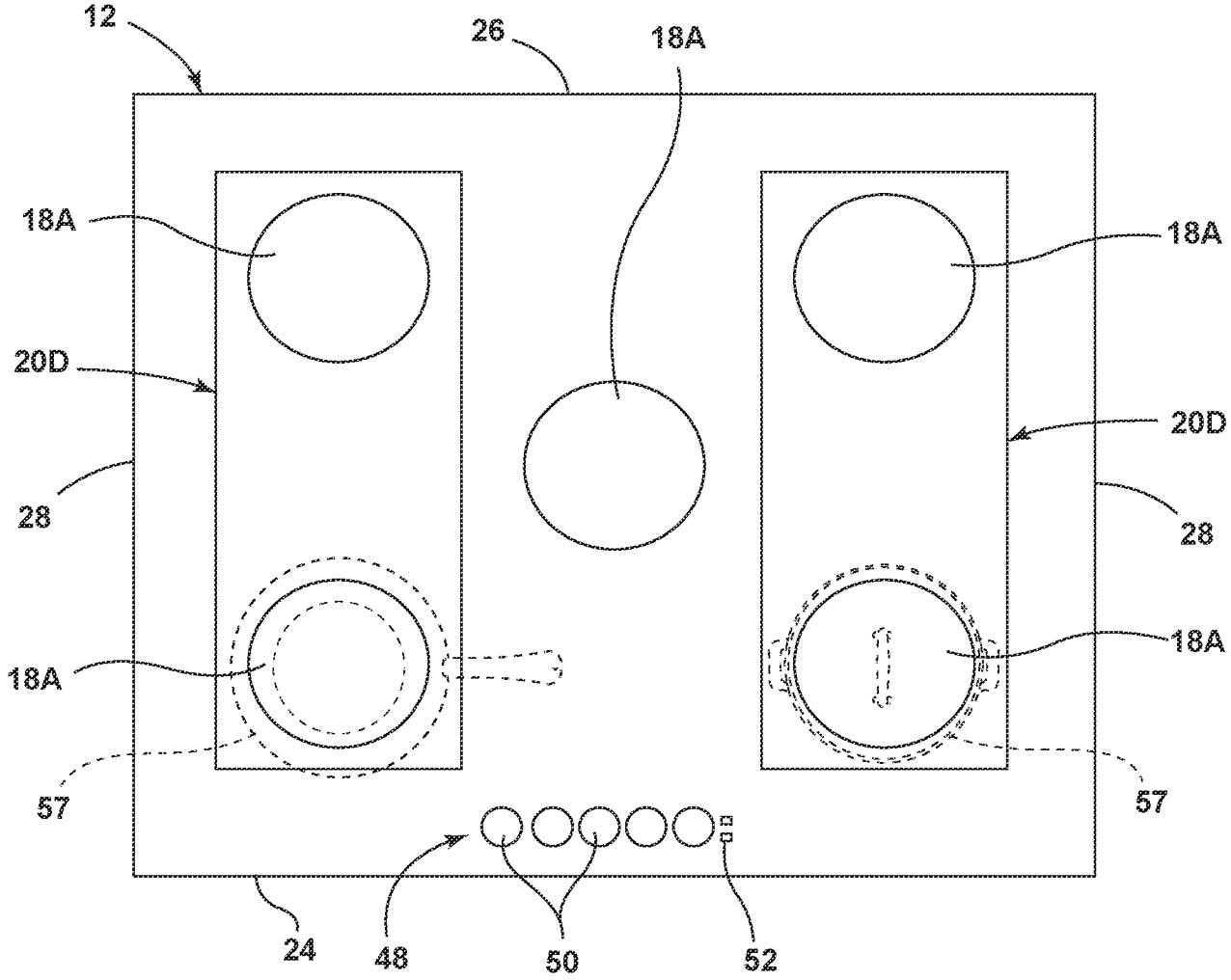
FIG. 6 is a top view of a cooktop with a pair of turrets of a second construction, according to an aspect of the present disclosure.

With reference now to FIG. 6, in one example implementation, the cooking appliance 10 may include more than one turret 20D in accordance with the fourth construction. More particularly, the cooking appliance 10 is illustrated as including a pair of turrets 20D each located along an opposite side edge 28. The longer sides of the turret 20D (e.g., the glass top 30 and optionally the underlying body) may extend in a direction from the front edge 24 towards the rear edge 26. Similar to the example implementation in FIG. 6, the cooking appliance 10 may alternatively include a pair of turrets 20E of the fifth construction, with each opposite ones of the front edge 24 and the rear edge 26. It should be appreciated that other turrets 20A-20G may be utilized in association with the burner in FIG. 6. In FIG. 6, a cooking vessel 57 on the left may be detected in an unsafe position, wherein the turret 20D is prevented from movement or at least movement into the retracted position. On the other hand, the cooking vessel 57 on the right is within the perimeter of the glass top 30 and therefore the turret 20D may be freely moved between all available positions while the burner 18A under the cooking vessel 57 remains energized.

Figure 7:
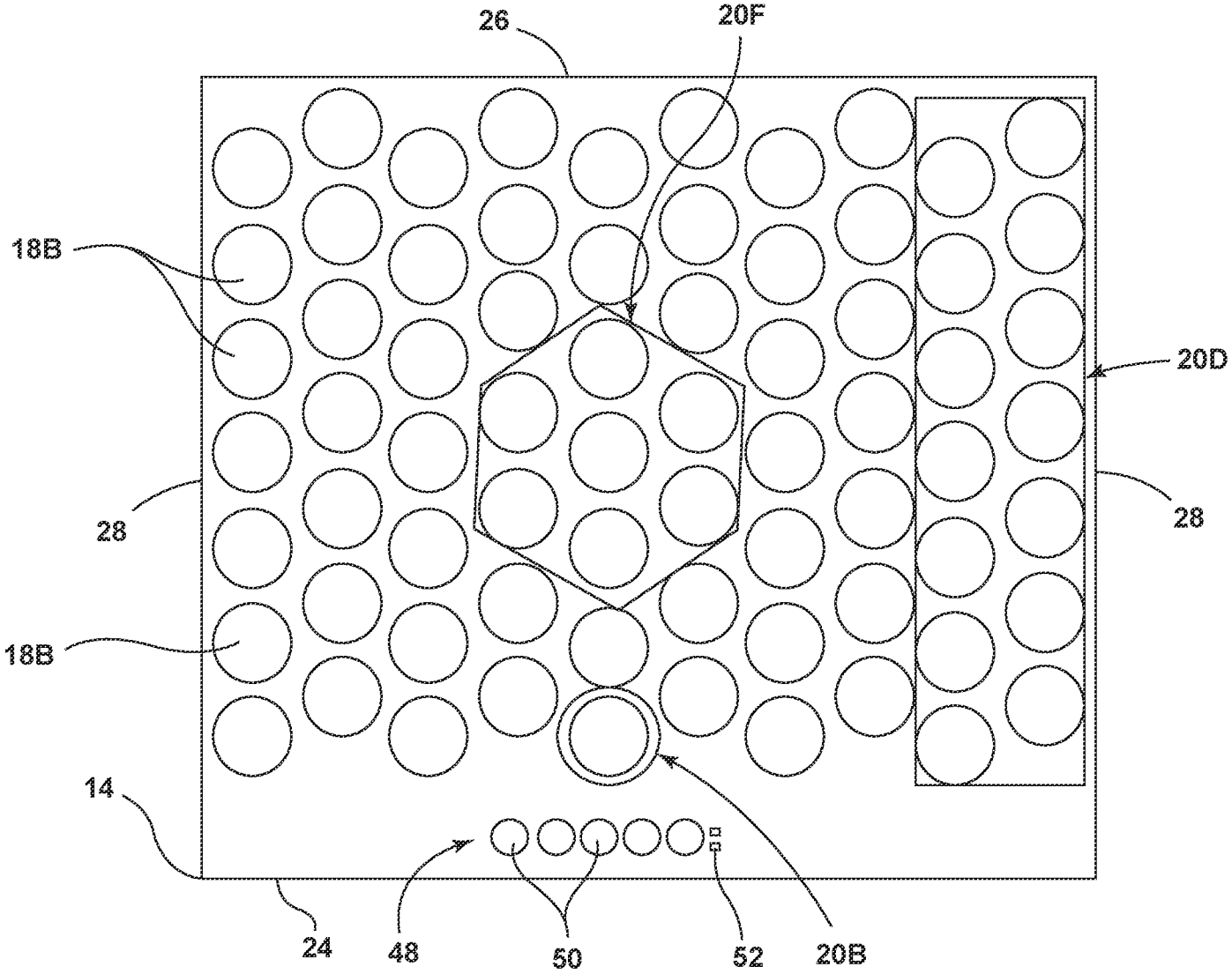
FIG. 7 is a top view of a cooktop with a plurality of turrets with different constructions, according to an aspect of the present disclosure.

With reference now to FIG. 7, the cooking appliance 10 may include a plurality of burners 18B in accordance with a second construction (i.e., flexible burners) that are arranged in rows and columns (e.g., ten or more burners 18B) that substantially cover the cooktop 12. In this arrangement, each burner 18B may be generally smaller than a traditional cooking vessel 57 and substantially the entire cooktop 12 may be selectively heatable to provide a flexible arrangement of cooking vessel shape and cooking vessel location. The presence sensor 56 may be located in or around the cooktop 12, and the control unit 100 may be configured to activate heating on whichever burners 18B the cooking vessel 57 is placed on. Any turret 20A-20G may be associated with the burners 18B in FIG. 7. In some embodiments, the control unit 100 may be configured to move turrets 20A-20G in association with areas of the cooktop 12 without a cooking vessel 57. In some embodiments, the control unit 100 may be configured to move turrets 20A-20G in association with areas of the cooktop 12 with a cooking vessel 57. In the illustrated implementation, the cooktop 12 includes one of the turrets 20B of the second construction, one of the turrets 20D of the fourth construction, and one of the turrets 20F of the sixth construction. However, any of the previously described constructions of the turrets 20A-20G may be implemented. In addition, additional turret constructions other than those illustrated in FIGS. 5A-5G may be implemented. For example, turrets having a glass top 30 with an outer perimeter defining a triangular shape, an L-shape, a rhomboidal shape, and other shapes (e.g., symmetrical or asymmetrical) may be utilized based on the density and spacing of the burners 18B with one or more burners 18B located on each turret. In some embodiments, each turret 20A-20F (e.g., or other constructions) may be connected to a plurality of burners 18B (e.g., one or more, two or more, five or more, ten or more, fifteen or more, twenty or more) to accommodate continued heating of a cooking vessel 57 without the cooking vessel 57 being located in an unsafe position. In some embodiments, one of the turrets 20F are connected to only a single burner 18B. In such embodiments, the control unit 100 may be configured to move turrets 20A-20F in close proximity to a burner 18B and/or turret 20A-20G with a detected presence of the cooking vessel 57. In this manner, the cooking appliance 10 may include a plurality of turrets 20A-G (e.g., connected to a single or plurality of burners 18A-B) that are moveable based on the detected presence of the cooking vessel 57, the size of the cooking vessel 57, and proximity to the cooking vessel 57. The turrets 20B, 20D, and 20F in FIG. 7 may share all of the same features, functionalities, and materials of those described in reference to FIGS. 1-4. In a similar manner, unless expressly stated, the turrets 20A-G described in reference to FIGS. 1-5G may share all of the same features, functionalities, and materials of those described in reference to FIG. 7.

Figure 8:
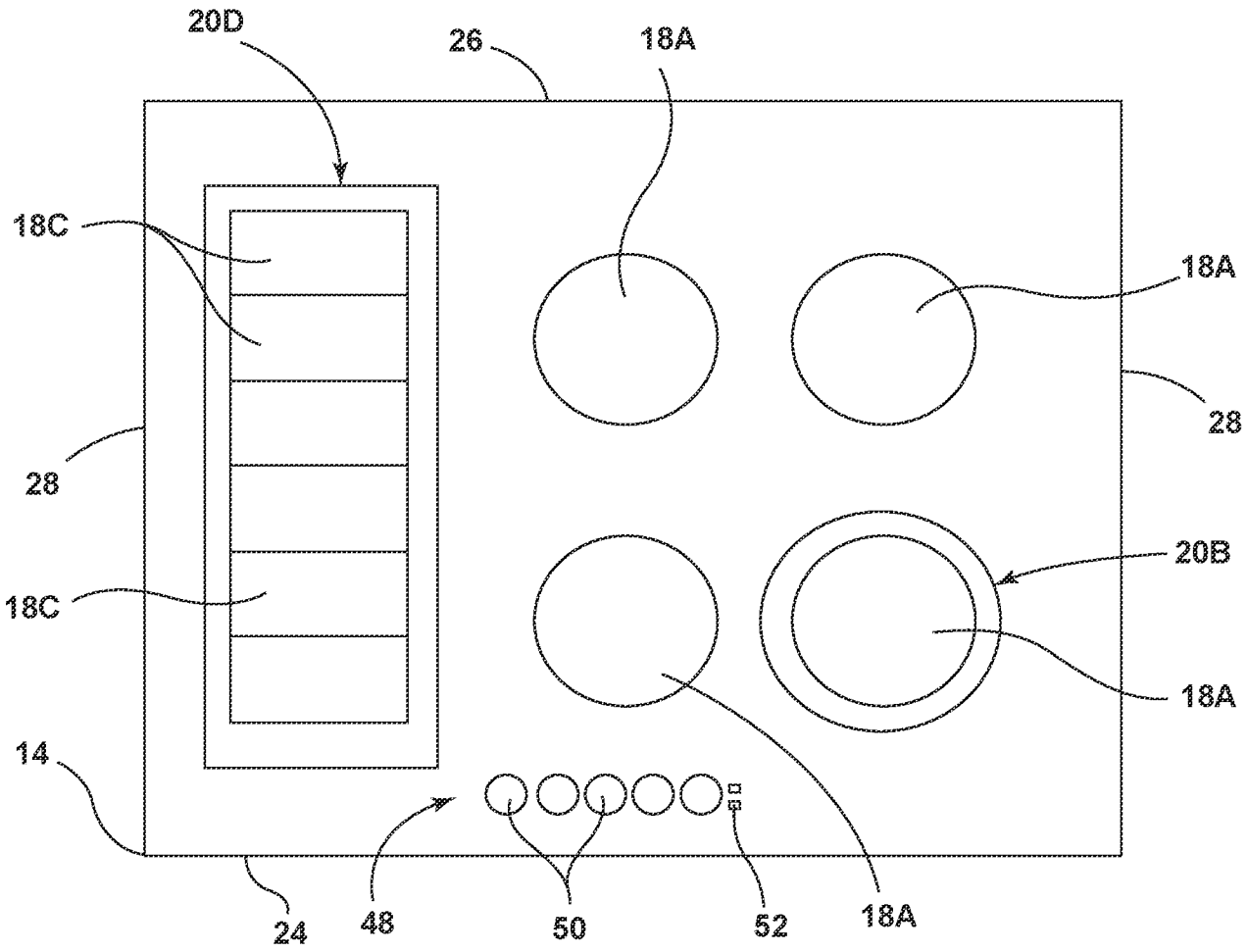
FIG. 8 is a top view of a cooktop with a turret of a third construction connected to a plurality of rectangular burners, according to an aspect of the present disclosure.

With reference now to FIG. 8, the cooking appliance 10 may include a plurality of burners 18B with at least two burners having different configurations. For example, the cooktop 12 may include a burner 18C in a third construction (i.e., a gradient burner) arranged with one or more (e.g., a plurality) of rectangular burners 18C, which may offer gradient heating options to a user. The cooktop 12 may also include one or more circular burners 18A for traditional cooking. In this arrangement, the turret 20D may be connected to the one or more rectangular burners 18C (select or each) and a turret 20B may be connected to the one or more circular burners 18A (select or each). The turrets 20B, 20D in FIG. 8 may share all the same features, functionalities, and materials of those described in reference to FIGS. 1-7. In a similar manner, unless expressly stated, the turrets 20A-G described in reference to FIGS. 1-7 may share all the same features, functionalities, and materials of those described in reference to FIG. 8.

Figure 9:
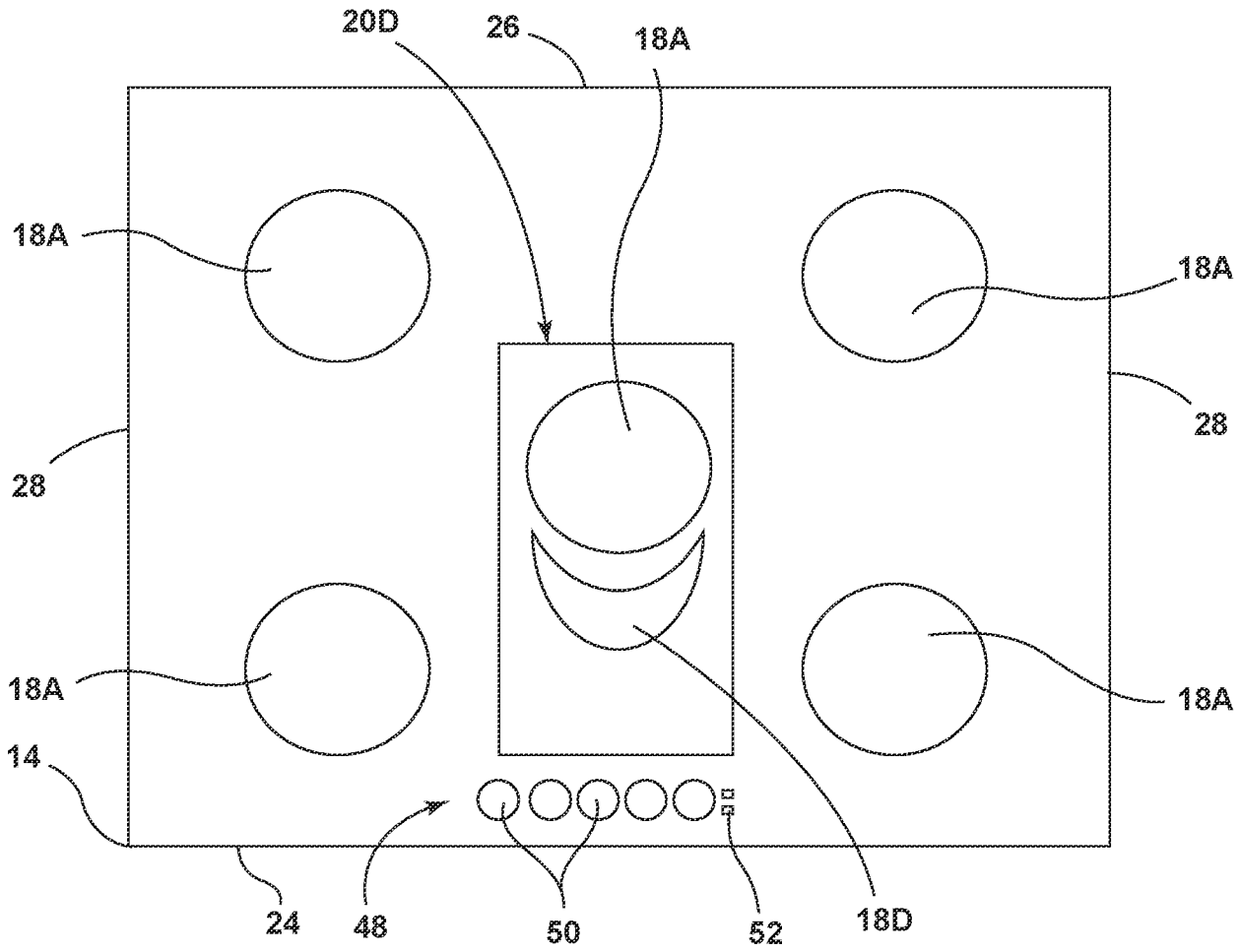
FIG. 9 is a top view of a cooktop with a turret connected to a pair of related burners, according to an aspect of the present disclosure.

With reference now to FIG. 9, the cooking appliance 10 may include a plurality of burners 18A, 18D with at least two burners having different configurations. For example, the cooktop 12 may include at least one burner 18A in close proximity and paired with a flexible cooking burner 18D with a fourth construction (i.e., a zone burner), which may offer different heating options to a user. The cooktop 12 may also include one or more circular burners 18A for traditional cooking. In this arrangement, the turret 20D may be connected to the one or more burners 18A and the paired flexible cooking burner 18D. Likewise, a turret 20A-20G may be connected to the one or more circular burners 18A (select or each). The turret 20D in FIG. 9 may share all the same features, functionalities, and materials of those described in reference to FIGS. 1-8. In a similar manner, unless expressly stated, the turrets 20A-G described in reference to FIGS. 1-8 may share all the same features, functionalities, and materials of those described in reference to FIG. 9.

With reference to FIGS. 1-9, it should be appreciated that a cooktop 12 could include one or more turret 20A-20G constructions and each turret 20A-20G may include one or more burners 18A-18D of the same or different configurations. The location of the turret 20A-20G may be located anywhere on the cooktop 12, for example, along the outer perimeter 14 or centrally.

Figure 10:
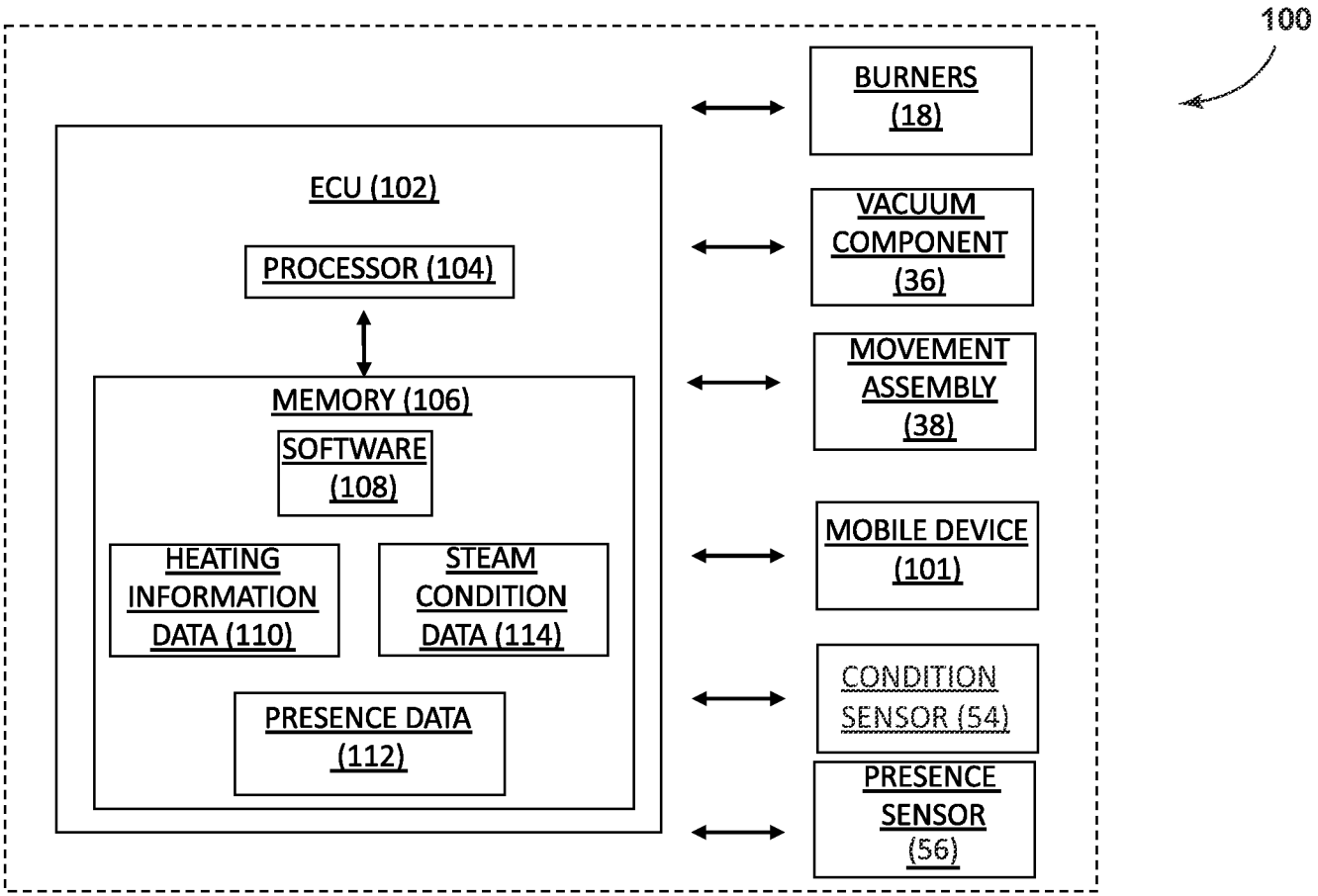
FIG. 10 is a schematic view of a control unit of a cooking appliance with a turret, according to an aspect of the present disclosure.

With reference now to FIG. 10, the control unit 100 may include an electronic control unit (ECU) 102. The ECU 102 may include a processor 104 and a memory 106. The processor 104 may include any suitable processor 104. Additionally, or alternatively, the ECU 102 may include any suitable number of processors, in addition to, or other than, the processor 104. The memory 106 may comprise a single disk or a plurality of disks (e.g., hard drives) and includes a storage management module that manages one or more partitions within the memory 106. In some embodiments, memory 106 may include flash memory, semiconductor (solid-state) memory, or the like. The memory 106 may include Random Access Memory (RAM), a Read-Only Memory (ROM), Electrically Erasable Programmable Read-Only Memory (EEPROM), or a combination thereof. The memory 106 may include instructions that, when executed by the processor 104, cause the processor 104 to, at least, perform the functions associated with the components of the control unit 100. The burners 18A-18D, the vacuum component 36, the movement assembly 38, the user interface 48, and a connected mobile computing device 101 (e.g., an application running on a mobile device, such as a phone, computer, or tablet) may, therefore, be controlled and/or receive instructions from the ECU 102. In some embodiments, functionalities and settings of the ECU 102 may be controlled by the mobile computing device 101. The memory 106 may, therefore, include software 108, heating information 110 (i.e., which burners 18A-18D are heated), presence data 112 (i.e., a location of a cooking vessel 57 obtained by presence sensor 56), and steam and/or smoke condition data 114 (i.e., the presence of steam and/or smoke over a threshold obtained by the condition sensor 54). The control unit 100 may be configured to perform the method steps as described herein.

Figure 11:
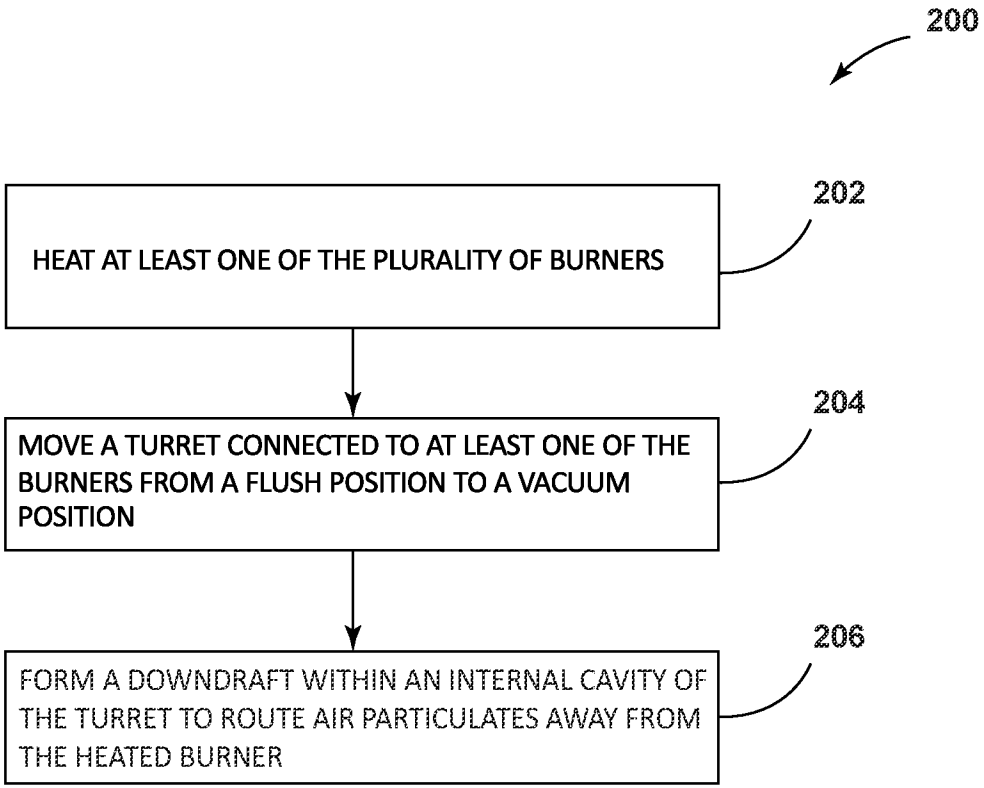
FIG. 11 is a method flow chart of venting a cooking appliance with a turret, according to an aspect of the present disclosure.

With reference now to FIG. 11, a method 200 of venting a cooking appliance with a plurality of burners 18A-18D and at least one turret 20A-20G connected to at least one of the burners 18A-18D is illustrated. The method 200 includes a step 202 where at least one of the plurality of burners 18A-18D is heated. For example, the heated burner 18A-18D may be connected to or spaced from the turret 20A-20G. The heated burner 18A-18D may be heated via input from a user interface 48 and/or a detected presence of a cooking vessel 57. The method 200 further includes a step 204 where the turret 20A-20G is moved from a flush position to a vacuum position. For example, the turret 20A-20G may be moved to an extended position or a recessed position. The turret 20A-20G may be moved via input from a user interface 48 and/or a detected air condition (e.g., the presence and quantity of steam, smoke, odors, or other particulates). If the heated burner 18A-18D is located on the turret 20A-20G, the burner 18A-18D may continue to be heated as the turret 20A-20G is moved from the flush position to the vacuum position. In some embodiments, the turret 20A-20G may not move if the detected presence of the cooking vessel 57 indicates that the cooking vessel 57 is in an unsafe position. The method 200 further includes a step 206 where a downdraft is formed within an internal cavity 22 of the turret 20A-20G to route air particulates (e.g., steam, smoke, odors, or other particulates) away from the heated burner 18A-18D.

The disclosure herein is further summarized in the following paragraphs and is further characterized by combinations of any and all of the various aspects described therein.

According to an aspect of the present disclosure, a cooking appliance includes a cooktop including an outer perimeter and defining at least one opening. A plurality of burners located on the cooktop and at least one burner of the plurality of burners is located on at least one turret that defines an internal cavity to direct a downdraft. The at least one turret is moveable within the at least one opening between at least one vacuum position and a flush position.

According to another aspect, a turret defines a top surface and at least one burner is located on the top surface of the turret.

According to yet another aspect, a top surface of a turret is coupled to a glass top that resides substantially on a same plane as a cooktop in a flush position.

According to still another aspect, a glass top of a turret resides above a cooktop in an at least one vacuum position.

According to another aspect, a glass top of a turret resides below a cooktop in an at least one vacuum position.

According to still another aspect, at least one burner that is located on a turret is configured to be heated in an at least one vacuum position and a flush position.

According to yet another aspect, at least one burner that is located on a turret is a single burner of a different size and shape than at least one other of a plurality of burners on a cooktop.

According to another aspect, at least one burner that is located on a turret includes two or more burners.

According to yet another aspect, at least one burner that is located on the turret includes a zone burner, a flexible burner, or a gradient burner.

According to still another aspect, a turret defines at least one vent port fluidically connected to an internal cavity.

According to another aspect, a presence sensor is configured to detect a presence of a cooking vessel on an at least one turret and a control unit is configured to receive the detected presence from the presence sensor and prevent the at least one turret from moving between a flush position and an at least one vacuum position if the cooking vessel is in an unsafe position.

According to yet another aspect, a power conduit extends between an at least one burner that is located on a turret to a control unit configured to administer heating of the at least one burner, the power conduit extending within an internal cavity of the turret.

According to another aspect of the present disclosure, a cooking appliance includes a cooktop having an outer perimeter and defining an opening and a condition sensor that is configured to detect a particulate presence of at least one of smoke, steam, or odors around the cooktop. A plurality of burners are located on the cooktop. At least one burner of the plurality of burners is located on a turret that defines an internal cavity to direct a downdraft. The turret is moveable within the opening between at least one vacuum position and a flush position. A control unit configured to receive the detected particulate presence from the condition sensor and generate a movement signal to move the turret from the flush position to the at least one vacuum position.

According to another aspect, a movement assembly is configured to, upon receiving a movement signal from a control unit, move a turret between a flush position and an at least one vacuum position automatically.

According to yet another aspect, a presence sensor is in communication with a control unit, the presence sensor configured to determine a presence of a cooking vessel over a turret.

According to still yet another aspect, a control unit is configured to, upon receiving a detected cooking vessel presence, prevent a turret from moving if the cooking vessel is in an unsafe position.

According to yet another aspect of the present disclosure, a cooking appliance includes a cooktop having an outer perimeter and defining a pair of openings. A pair of burners are located on the cooktop. A pair of turrets with each turret located in a different one of the pair of openings. Each turret is connected to a different one of the pair of burners. Each turret defines an internal cavity to direct a downdraft and each turret is moveable within a respective one of the at least two openings between at least one vacuum position and a flush position.

According to another aspect, a presence sensor configured to detect a presence of a cooking vessel on one of at least two turrets.

According to yet another aspect, a control unit is configured receive a detected presence from a presence sensor and to move one of at least two turrets without a cooking vessel.

According to still yet another aspect, a turret includes a glass top that resides above a cooktop in an at least one vacuum position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance comprising:

a cooktop including an outer perimeter and defining at least one opening;

a plurality of burners located on the cooktop; and at least one burner but not all of the plurality of burners located on at least one turret that defines at least one vent port fluidically connected to an internal cavity to direct a downdraft, the at least one turret is moveable within the at least one opening between a flush position where the vent port is located under the cooktop and at least one vacuum position where the vent port is raised above the cooktop.

2. The cooking appliance of claim 1, wherein the turret defines a top surface and the at least one burner is located on the top surface of the turret.

3. The cooking appliance of claim 2, wherein the top surface of the turret is coupled to a glass top that resides substantially on a same plane as the cooktop in the flush position.

4. The cooking appliance of claim 3, wherein the glass top resides above the cooktop in the at least one vacuum position.

5. The cooking appliance of claim 3, wherein the at least one vacuum position further includes a retracted position where the glass top resides below the cooktop and the downdraft is directed through the at least one opening.

6. The cooking appliance of claim 1, wherein the at least one burner that is located on the turret is configured to be heated in the at least one vacuum position and the flush position.

7. The cooking appliance of claim 1, wherein the at least one burner that is located on the turret is a single burner of a different size and shape than at least one other of the plurality of burners.

8. The cooking appliance of claim 1, wherein the at least one burner that is located on the turret includes two or more burners.

9. The cooking appliance of claim 1, wherein the at least one burner that is located on the turret includes a zone burner, a flexible burner, or a gradient burner.

10. The cooking appliance of claim 1, wherein the turret is located within and spaced from the outer perimeter of the cooktop and the at least one vent port includes a plurality of vent ports facing different edges of the outer perimeter of the cooktop.

11. The cooking appliance of claim 1, further including a presence sensor configured to detect a presence of a cooking vessel on the at least one turret and a control unit configured to receive the detected presence from the presence sensor and prevent the at least one turret from moving between the flush position and the at least one vacuum position if the cooking vessel is in an unsafe position.

12. The cooking appliance of claim 1, wherein a power conduit extends between the at least one burner that is located on the turret to a control unit configured to administer heating of the at least one burner, the power conduit extending within the internal cavity.

13. A cooking appliance comprising:

a cooktop including an outer perimeter and defining an opening;

a condition sensor configured to detect a particulate presence of at least one of smoke, steam, or odors around the cooktop;

a plurality of burners located on the cooktop;

at least one burner of the plurality of burners located on a turret that defines an internal cavity to direct a downdraft, the turret is moveable within the opening between at least one vacuum position and a flush position; and a control unit configured to receive the detected particulate presence from the condition sensor and generate a movement signal to move the turret from the flush position to the at least one vacuum position.

14. The cooking appliance of claim 13, wherein a movement assembly is configured to, upon receiving the movement signal from the control unit, move the turret between the flush position and the at least one vacuum position automatically.

15. The cooking appliance of claim 13, further including a presence sensor in communication with the control unit, the presence sensor configured to determine a presence of a cooking vessel over the turret.

16. The cooking appliance of claim 15, wherein the control unit is configured to, upon receiving the detected cooking vessel presence, prevent the turret from moving if the cooking vessel is in an unsafe position.

17. A cooking appliance comprising:

a cooktop including an outer perimeter and defining a pair of openings;

a pair of burners located on the cooktop;

a pair of turrets with each of the turrets located in different one of the pair of openings and connected a different one of the pair of burners, each turret defining an internal cavity to direct a downdraft, each turret is moveable within a respective one of the at least two openings between at least one vacuum position and a flush position; and a presence sensor configured to detect a presence of a cooking vessel on one of the at least two turrets.

18. The cooking appliance of claim 17, further including a control unit configured to receive the detected presence from the presence sensor and to move the one of the at least two turrets without the cooking vessel.

19. The cooking appliance of claim 17, wherein the turret includes a top surface that resides above the cooktop in the at least one vacuum position.

* * * * *